United States Patent [19]

Finke et al.

[11] Patent Number: 4,615,437

[45] Date of Patent: Oct. 7, 1986

[54] BOTTLE CLOSURE WITH SEPARABLE CAPSULE

[75] Inventors: Robert-Günter Finke, Finnentrop; Clemens Schumacher, Sundern; Albert Kolb, Darmstadt-Eberstadt; Horst Lautenschläger, Modautal; Jürgen Konetzka, Darmstadt-Eberstadt, all of Fed. Rep. of Germany

[73] Assignee: Robert Finke Kommanditgesellschaft, Finnentrop, Fed. Rep. of Germany

[21] Appl. No.: 757,547

[22] Filed: Jul. 19, 1985

[30] Foreign Application Priority Data

Jul. 20, 1984 [DE] Fed. Rep. of Germany ..... 3426739

[51] Int. Cl.[4] ..... B65D 25/08

[52] U.S. Cl. ..... 206/222; 215/DIG. 8

[58] Field of Search ..... 206/222, 219; 215/DIG. 8

[56] References Cited

U.S. PATENT DOCUMENTS

| | | | |
|---|---|---|---|
| 3,156,369 | 11/1964 | Bowes et al. | 206/222 |
| 3,344,914 | 10/1967 | Bloom et al. | 206/222 |
| 3,968,872 | 7/1976 | Cavazza | 206/222 |
| 4,024,952 | 5/1977 | Leitz | 215/DIG. 8 |
| 4,132,308 | 1/1979 | Goncalves | 215/DIG. 8 |
| 4,221,291 | 9/1980 | Hunt | 206/222 |
| 4,386,696 | 6/1983 | Goncalves | 215/DIG. 8 |

*Primary Examiner*—Joseph Man-Fu Moy

*Attorney, Agent, or Firm*—Martin A. Farber

[57] ABSTRACT

A container for holding contents as two separate components which can be mixed together later. The container comprises a cup positioned in a neck of the container for receiving a first of the components; a screwcap coordinated with the neck of the container and having a collar extending into the cup, a front edge of said collar forming a strike edge for separating the cup in the region of a line of intended breakage upon a further screwing on of the screwcap beyond a basic position for storage; and a wall of the cup has an annular step, and the strike edge of the collar comes flush on the annular step on the wall of the cup, the step—forming the place of intended breakage—being located at a distance above the bottom of the cup, there being a bead extending towards an outer surface of the collar and projecting inwardly from the inner surface of the wall of the cup, the step lying below said bead; and a clip shoulder is disposed on the collar and engages the bead of the cup wall.

8 Claims, 3 Drawing Figures

BOTTLE CLOSURE WITH SEPARABLE CAPSULE

FIELD AND BACKGROUND OF THE INVENTION

The present invention concerns a container, such as a bottle, for holding contents as two separate components which can be mixed together later. The two-component container has a cup positioned in the neck of the container for receiving one of the components, and a screwcap associated with the neck of the container and having a collar extending into the cup. The front edge of said collar forms a strike edge for a separation of the bottom of the cup from the side wall of the cup in the region of a line of intended breakage upon a further screwing on of the screwcap beyond the basic position for storage. Protection of the contents is attained by the fact that a strike edge of the collar is flush with an annular step on the wall of the cup, which step—forming the place of intended breakage—is located at a distance above the bottom of the cup. The step lies below a bead which extends towards the outer surface of the collar and protrudes inwardly from the inner surface of the wall of the cup. Prior to the foregoing breakage, the cup within the cap forms a capsule for holding the first component, while the second component sets separately with the body of the container.

SUMMARY OF THE INVENTION

The object of the invention is to improve the possibility of safely delivering cup and screwcap in prefilled form.

According to the invention, a clip shoulder on the collar invention, in the manner that a clip shoulder on the collar engages behind a bead on the wall of the cup.

As a result of this development, the top of the container which contains the first component is optimally closed so that the possibility is improved of being able more safely to deliver cup and screwcap in filled condition as if the container were a small-quantity doser. There is a firm interengagement of the capsule-forming parts. In order to release the contents, the closure path need not be moved over again; rather, upon a further screwing-on of the cap towards the body of the container, the place of intended breakage is severed. In a two-component container of this type, it is furthermore advantageous that the wall of the cup form on its outer surface, adjacent the section on the bottom-side of the cup, a supporting wall which extends from the section lying in front of the place of intended breakage to the level of the lower side of the bottom of the cup. Such a supporting wall acts as spacer and holds the section of the cup, which can be torn off, free of assembly stresses. The supporting wall, instead of being formed, for instance, of small individual feet, can be developed advantageously as a closed annular collar, whereby closing forces are distributed over the entire cross section of the wall. It is furthermore advantageous for the wall of the cup to bear spacer ribs. The latter provide a balanced support in the neck of the bottle while, on the other hand, they advantageously stabilize the cup itself. It is furthermore advantageous for the rim of the cup to form an upwardly open annular groove. The rim is thus relatively flexible, which favors the obtaining of a tightly closing seat. Finally, an advantageous embodiment is obtained by a plurality of beads on the cup wall which lie vertically one above the other. Such beads define, for example, different depths of insertion, with a desired inserted position being secured in each case. Furthermore, upon movement over each other, the beads also permit the escape of air.

The object of the invention will be explained in further detail below, with reference to an embodiment shown in the drawing, in which.

Figure 1:
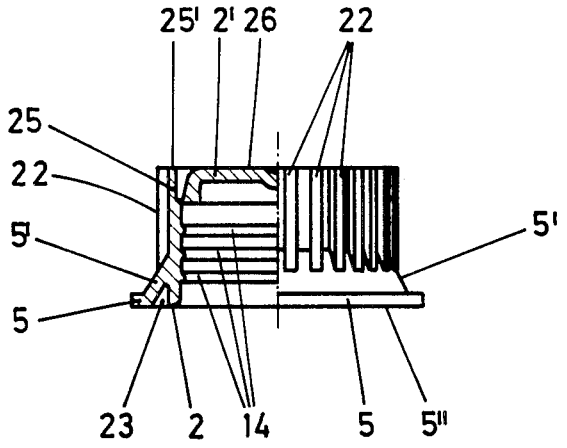
FIG. 1 is a central cross section through the cup.

The two-component container receives the first component I in a cup 2 which is introduced into the container neck 1 and the other component II in the body of the container, the body being of larger volume than the capsule.

The cup 2 is severed for the mixing of the two components. As severing tool there is used a screwcap which is formed to serve also as closure.

The cup 2, which is made of plastic, forms in its upper, substantially cylindrically developed section, an outwardly directed rim 5. The latter extends over the corresponding front edge 1' of the container neck 1. The outer surface of the cup wall has spacer ribs 22 which extend in the direction of insertion of the cup, and exert a clamping action against the inner wall of the neck of the package, thus producing good assurance against twisting. Furthermore, such spacer ribs 22 also reinforce the cup wall W. The width of a rib corresponds to the rib-free zone in between successive ribs.

On their end facing the rim of the cup, the spacer ribs 22 pass into a diverging section 5' at the rim which forms a frustoconical resting surface, extending in sealing fashion into the neck 1 and, in particular, is elastic due to an annular groove 23 which is open on top. As seen in cross section, the annular groove is of notch-shaped development with a flank which extends obliquely towards the outside and a steep flank, i.e. a flank extending concentrically to the longitudinal central axis z—z of the two-component package which is developed with rotational symmetry.

Figure 3:
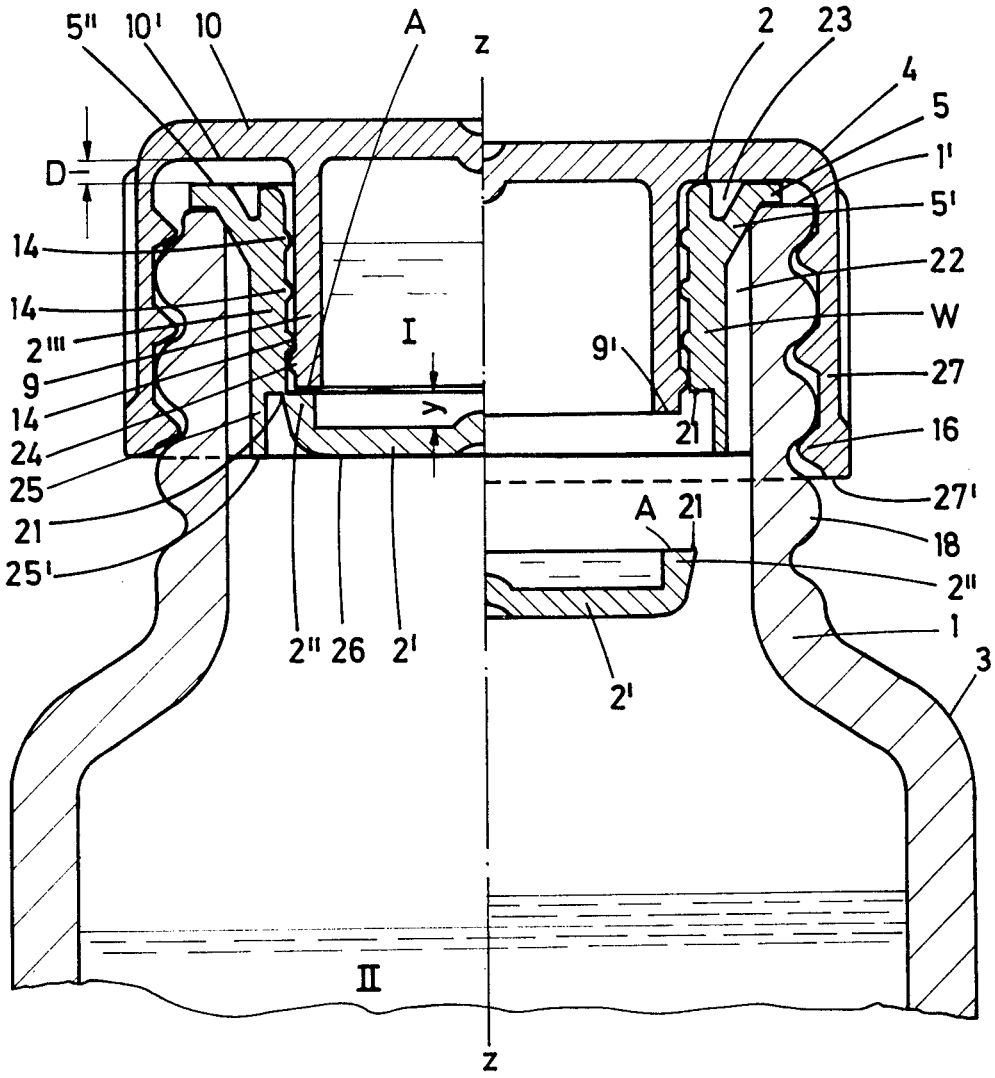
FIG. 3 shows the cup and screwcap combined to form a capsule, screwed onto a bottle neck (the left half of the section shows the situation before release of the first component and the right half after the release of the first component by the tearing off of the bottom section of the cup.)

The cup 2, which can be severed by means of the screwcap 4, is provided with a line of intended breakage. The latter is formed by an annular step A on the cup wall W, which step is located towards the inside of the cup and at a distance y from the bottom of the cup. The strike edge 9' of a collar 9 formed on the screwcap strikes against the said step. The collar extends from a screwcap cover 10 and is developed as a cylindrical annular wall. The surface of the strike edge 9' is perpendicular to the longitudinal axis z—z of the package. The strike edge 9' is essentially on a line with the annular step A of the cup wall W. In the situation shown on the left-hand side of FIG. 3, the strike edge 9' of the collar is at a slight distance from the annular step A.

The collar 9, which extends into the cup 2, is secured against being pulled out. For this purpose, the cup wall W is provided on its inner side with at least one annular bead 14. Said bead extends horizontally in the neighborhood of the annular step A and an annular clip shoulder 24 formed on the outer surface of the collar engages behind it. This clip shoulder, which is located at a slight distance from the free end of the collar 9, moves away resiliently upon an attaching of cup and screwcap. As can be noted from the drawing, three beads 14 lying vertically one above the other are developed on the inside of the cup wall. The distance between the beads 14 corresponds approximately to twice the width of a bead, the beads assuring not only the axial holding in place of the parts forming the capsule, but also a good seal.

Figure 2:
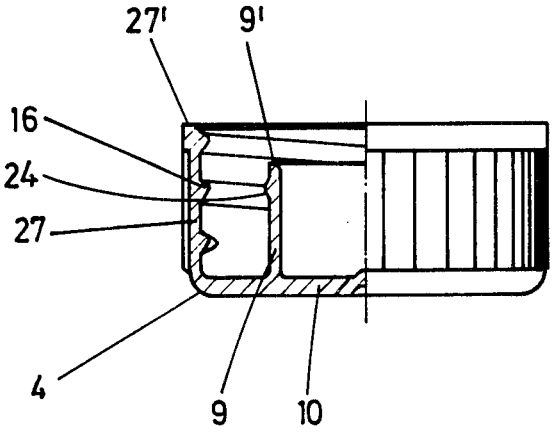
FIG. 2 is a central cross section through the screwcap.

In order to fill the capsule, which receives a very small quantity, the screwcap is placed on its back as shown in FIG. 2. The interior of the upward-extending collar forms the filling space. The cup is then attached, with he opening of the cup facing downward. The clip shoulders 24 then pass in succession, depending on the depth of insertion, over one or more of the beads 14 which define the depth of insertion.

In order upon this assembling to prevent any impairment from the bottom section 2' connected via the line of intended breakage to the upper section 2''' of the cup, the cup wall W is continued, adjacent the cup bottom section 2'', as a supporting wall 25. For all practical purposes, this is a continuation of somewhat reduced cross section of the cup wall. This end wall extends from the region of the place of intended breakage and continues to the level of the lower side 26 of the bottom of the cup. The end surface 25' can even extend slightly beyond this lower side 26 of the bottom of the cup. An impact tool which might be applied flat, therefore, would not extend down to the bottom side 26 of the bottom of the cup even upon slight axial compression of the wall. Aside from the protective bulwark formed by the supporting wall 25, another protective covering can also be used, namely the substantially cylindrically shaped outer wall 27 of the screw cap 4, in the manner that the end surface 25' of the supporting wall 25 is brought flush with, i.e. in the same plane as, the end wall 27' of the cap wall 27. In this fully inserted position, a slight annular spacing remains at the strike edge 9' of the collar 9. Furthermore a space D remains between the top 5'' of the collar 9 and the corresponding inner surface 10' of the screwcap cover 10.

The spacer ribs 22 terminate at the same level as the end surface 25', so that the resting surface is further increased by the front ends of the spacer ribs.

For use, the body of the container 3 of larger size, which contains water, for instance, is attached by the threaded engagement 16/18 of screwcap 4 and bottle neck 1. In this way there is established a basic position, as can be noted from the left-hand half of FIG. 3, in which the neck 1 and cup 2 are therefore still apart. Only upon the further training of the screw cap 4 does the strike edge 9' of the collar approach the annular step A of the cup wall W. The threaded engagement between screwcap 4 and the neck of the package is of such length that the lower section 2'' of the cup 2 is separated, upon the further screwing, while the upper section 2''' remains in the neck of the bottle. The bridge of material 21, present like a film hinge between the two sections 2'' and 2''' of the cup wall W which are off-set from each other in radial direction, is torn. The separated section 2'' of the cup falls into the package 3. The two components can now be mixed well by shaking. In this connection, the section of the cup 2 which has been torn off serves at the same time as a shaking and mixing member. During the shaking, the tight closure is retained between the collar and the wall of the cup.

After removal of the screwcap the mixed substance can be poured out.

We claim:

1. A container for holding contents as two separate components which can be mixed together later, comprising:

a cup positioned in a neck of the container for receiving a first of said components;

a screwcap coordinated with the neck of the container and having a collar extending into the cup, a front edge of said collar forming a strike edge for separating the cup in the region of a line of intended breakage upon a further screwing on of the screwcap beyond a basic position for storage; and wherein a wall of the cup has an annular step, and the strike edge of the collar comes flush on said annular step on the wall of the cup, said step—forming the place of intended breakage—being located at a distance above the bottom of the cup, there being a bead extending towards an outer surface of the collar and projecting inwardly from the inner surface of the wall of the cup, said step lying below said bead; and wherein a clip shoulder is disposed on the collar and engages behind the bead of the cup wall.

2. The two-component container according to claim 1, wherein the outer surface of the cup wall carries spacer ribs.

3. The two-component container according to claim 1, wherein a rim of the cup forms an annular groove which is open towards a top of the cup.

4. The two-component container according to claim 1, further comprising beads arranged vertically one above the other on the cup wall.

5. A container for holding contents as two separate components which can be mixed together later, comprising:

a cup positioned in a neck of the container for receiving a first of said components;

a screwcap coordinated with the neck of the container and having a collar extending into the cup, a front edge of said collar forming a strike edge for separating the cup in the region of a line of intended breakage upon a further screwing on of the screwcap beyond a basic position for storage; and wherein a wall of the cup has an annular step, and the strike edge of the collar comes flush on said annular step on the wall of the cup, said step—forming the place of intended breakage—being located at a distance above the bottom of the cup, there being a bead extending towards an outer surface of the collar and projecting inwardly from the inner surface of the wall of the cup, said step lying below said bead; and wherein the cup wall forms on its outer surface, adjacent to a bottom of the cup, a supporting wall which originates from a section located in front of the line of intended breakage and extends to a level of a bottom side of the bottom of the cup.

6. The two-component container according to claim 5, wherein the supporting wall if formed in a closed annular collar.

7. The two-component container according to claim 5, wherein the outer surface of the cup wall carries spacer ribs.

8. The two-component container according to claim 5, wherein a rim of the cup forms an annular groove which is open towards a top of the cup.

* * * * *